US010832645B2

(12) United States Patent
Davey et al.

(10) Patent No.: US 10,832,645 B2
(45) Date of Patent: Nov. 10, 2020

(54) TRANSDUCER APPARATUS FOR A LABROSONE AND A LABROSONE HAVING THE TRANSDUCER APPARATUS

(71) Applicant: AUDIO INVENTIONS LIMITED, Farnborough (GB)

(72) Inventors: Paul Davey, Farnborough (GB); Brian Smith, Farnborough (GB)

(73) Assignee: Audio Inventions Limited, Farnborough (GB)

( * ) Notice: Subject to any disclaimer, the term of this patent is extended or adjusted under 35 U.S.C. 154(b) by 0 days.

(21) Appl. No.: 16/480,932

(22) PCT Filed: Jan. 25, 2018

(86) PCT No.: PCT/GB2018/050215
§ 371 (c)(1),
(2) Date: Jul. 25, 2019

(87) PCT Pub. No.: WO2018/138504
PCT Pub. Date: Aug. 2, 2018

(65) Prior Publication Data

US 2020/0005752 A1 Jan. 2, 2020

(30) Foreign Application Priority Data

Jan. 25, 2017 (GB) ..... 1701298.0

(51) Int. Cl.
*G10H 3/12* (2006.01)
*G10D 7/10* (2006.01)
(Continued)

(52) U.S. Cl.
CPC ..... *G10H 3/125* (2013.01); *G10D 7/10* (2013.01); *G10D 9/03* (2020.02); *G10H 3/22* (2013.01);
(Continued)

(58) Field of Classification Search
CPC ..... G10H 1/00; G10H 2220/521; G10H 2220/525; G10H 2210/066; G10H 2220/561
See application file for complete search history.

(56) References Cited

U.S. PATENT DOCUMENTS 2,138,500 A 11/1938 Miessner
3,429,976 A 2/1969 Tomcik
(Continued)

FOREIGN PATENT DOCUMENTS

CN 104810012 A 7/2015
DE 3839230 A1 5/1990
(Continued)

OTHER PUBLICATIONS

Gibiat et al., "Acoustical Impedance Measurements by the Two-Microphone-Three-Calibration (TMTC) Method", The Journal of the Acoustical Society of America, American Institute of Physics for The Acoustical Society of America, New York, NY, US, vol. 88, No. 6, Dec. 1990, pp. 2533-2545.

*Primary Examiner* — Marlon T Fletcher
(74) *Attorney, Agent, or Firm* — Jason P. Mueller; FisherBroyles, LLP

(57) ABSTRACT

A transducer apparatus for a labrosone is disclosed, the labrosone having a labrosone resonant chamber. A labrosone speaker delivers a sound signal to the labrosone resonant chamber. A labrosone microphone receives a resultant sound from the labrosone resonant chamber. A mouthpiece microphone receives sound from a labrosone mouthpiece. An electronic processor is connected to the labrosone speaker, and receives signals from the labrosone microphone and the mouthpiece microphone. The electronic processor generates an excitation signal which is delivered as an acoustic excitation signal to the labrosone resonant chamber by the labrosone speaker. The electronic processor uses the signals
(Continued)

from the labrosone microphone and the mouthpiece microphone to determine a desired musical note which a player of the labrosone wishes to play. The electronic processor then synthesizes and outputs the desired musical note to an output device, whereby the musical note is played audibly and/or displayed visually to the player.

23 Claims, 3 Drawing Sheets

(51) Int. Cl.
*G10H 3/22* (2006.01)
*G10D 9/03* (2020.01)

(52) U.S. Cl.
CPC . *G10H 2220/361* (2013.01); *G10H 2230/171* (2013.01)

(56) References Cited

U.S. PATENT DOCUMENTS

| | | | | |
|---|---|---|---|---|
| 3,558,795 | A | 1/1971 | Barcus et al. | |
| 3,571,480 | A | 3/1971 | Tichenor et al. | |
| 4,233,877 | A | 11/1980 | Okami | |
| 5,131,310 | A | 7/1992 | Kunimoto | |
| 5,245,130 | A | 9/1993 | Wheaton | |
| 5,668,340 | A | 9/1997 | Hashizume | |
| 5,929,361 | A | 7/1999 | Tanaka | |
| 7,220,903 | B1 | 5/2007 | Bronen | |
| 9,417,217 | B2 | 8/2016 | Nikolovski | |
| 10,170,091 | B1 | 1/2019 | Tabata | |
| 10,229,663 | B2 | 3/2019 | Smith et al. | |
| 2006/0027074 | A1 | 2/2006 | Masuda et al. | |
| 2007/0068372 | A1 | 3/2007 | Masuda et al. | |
| 2007/0144336 | A1* | 6/2007 | Fujii | G10H 3/24 84/723 |
| 2012/0230155 | A1 | 9/2012 | Kawaguchi | |
| 2014/0224100 | A1 | 8/2014 | Vassilev | |
| 2014/0256218 | A1* | 9/2014 | Kasdas | A63H 5/00 446/416 |
| 2015/0101477 | A1 | 4/2015 | Park et al. | |
| 2018/0090120 | A1 | 3/2018 | Kasuga | |
| 2018/0137848 | A1 | 5/2018 | Souvestre | |
| 2018/0218720 | A1* | 8/2018 | Smith | G10H 3/125 |
| 2018/0268791 | A1 | 9/2018 | Okuda et al. | |
| 2019/0156808 | A1 | 5/2019 | Smith et al. | |
| 2020/0005752 | A1* | 1/2020 | Davey | G10H 3/26 |

FOREIGN PATENT DOCUMENTS

| | | | |
|---|---|---|---|
| EP | 1585107 | A2 | 10/2005 |
| EP | 1760690 | A2 | 3/2007 |
| EP | 1804236 | A1 | 7/2007 |
| EP | 2650870 | A1 | 10/2013 |
| FR | 2775823 | A1 | 9/1999 |
| GB | 2537104 | A | 10/2016 |
| GB | 2559135 | A | 8/2018 |
| GB | 2559144 | A | 8/2018 |
| JP | 2002278556 | A | 9/2002 |
| JP | 2005122099 | A | 5/2005 |
| JP | 2007065197 | A | 3/2007 |
| JP | 2008076838 | A | 4/2008 |
| JP | 2011154151 | A | 8/2011 |
| JP | 2013164542 | A | 8/2013 |
| JP | 2014232153 | A | 12/2014 |
| WO | 2018138501 | A1 | 8/2018 |
| WO | 2018138504 | A1 | 8/2018 |

* cited by examiner

TRANSDUCER APPARATUS FOR A LABROSONE AND A LABROSONE HAVING THE TRANSDUCER APPARATUS

CROSS-REFERENCE TO RELATED APPLICATIONS

This application is a national stage entry under 35 U.S.C. 371 of PCT Patent Application No. PCT/GB2018/050215, filed Jan. 25, 2018, which claims priority to United Kingdom Patent Application No. 1701298.0, filed Jan. 25, 2017, the entire contents of each of which is incorporated herein by reference.

This disclosure relates to a transducer apparatus for a labrosone and to a labrosone having the transducer apparatus. Labrosones are often called brass instruments and include trumpets, trombones, comets, alto horns, baritone horns, fluglehorns, mellophones, euphoniums, helicons, tubas, sackbuts, hunting horns, sousaphones and French horns. They are instruments that produce sound by vibration of air in a resonator in sympathy with the vibration of the player's lips.

Musicians are sometimes constricted on where and when they can practice. Being able to practice an instrument in a "silent" mode, in which the instrument is played without making a noise audible to those in the immediate vicinity, can be advantageous. At other times, the musician may wish to have the music played amplified to be heard even more clearly or by a large audience.

For a labrosone or brass instrument the vibration of the player's lips acts like a double-reed to stimulate a standing wave in the resonator chamber in the body of the instrument. The player can select notes in two ways:

1. By lengthening or shortening the tube: for a trumpet extra lengths of tubing are introduced using a system of valves; for a trombone the slide presents a variable length of tubing.
2. For each length of tubing in use the player can select one of the resonant harmonics by tuning the vibration of his/her lips to the desired harmonic.

There are several harmonics possible per tube length, not just the fundamental (first harmonic in some nomenclature); or else for instance for a trumpet there would just be the 8 notes possible given the 3 valves. A trumpet has a range of over 3 octaves. The effective tube length mandates that only certain harmonic frequencies will resonate (play). If the player's lip harmonic is not sufficiently close to one of the tube harmonics then no clear will sound since resonance will not occur.

The disclosure provides a transducer apparatus according to claim 1 or claim 10.

The disclosure also provides a labrosone according to claim 21.

The disclosure provides apparatus comprising a transducer apparatus in combination with computer apparatus and/or a smartphone as claimed in claim 22 or claim 23.

An embodiment of the disclosure will now be described with reference to the accompanying figures in which.

Figure 1:
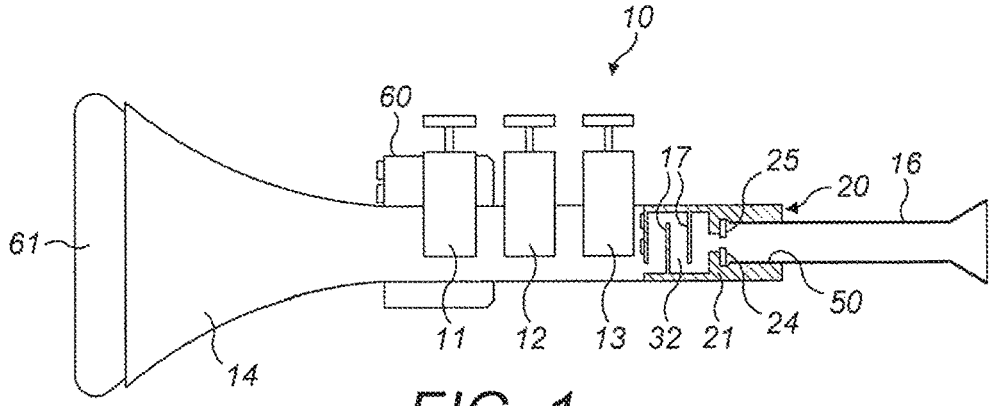
FIG. 1 is a schematic view in part cross-section of a trumpet having a transducer apparatus according to the disclosure.

In FIG. 1 there can be seen a trumpet 10 having valves 11, 12 and 13 and a bell 14.

The mouthpieces of brass instruments are removable to permit cleaning of the instrument's "lead-pipe" and for the player to use a mouthpiece of choice. In an embodiment, the mouthpiece 16 is initially removed and the opening capped off with a transducer apparatus 20 according to the disclosure. The transducer apparatus can be configured to replace a lead-pipe of the instrument. The transducer apparatus 20 includes a microphone 23, a speaker 22 and an electronic processor 41 (see FIG. 3). As described below, the electronic processor 41 generates a chirp stimulus signal (delivered to a resonant chamber 28 of the trumpet by the speaker 22) and measures the response to the chirp stimulus (such response being detected by the microphone 23). In this way the processor 41 is able to determine the length of the tube in use as selected by the player. For a trombone, with its infinite number of slide positions this approach implies that the processor 41 can detect glissandi. In addition, for a trumpet the processor 41 can detect when the player has only partially closed a valve, so-called "half-valving"; this is an advantage compared to existing apparatus which detects depressed valves using a set of switches attached to the valve assembly.

Having determined the length of tube in use it is necessary for the processor 41 to establish which harmonic the player is selecting. This is accomplished by providing in the transducer apparatus 20 an additional cavity 32. As mentioned above the previously removed player's mouthpiece 16 is inserted into a socket 50 in the transducer apparatus 20, which either replaces or supplements the lead-pipe of the instrument. The FIG. 1 shows this arrangement clearly. The transducer apparatus 20 has a housing 21 which has a socket 50 in a female end thereof into which the mouthpiece 16 is inserted. The housing 21 also has a male end, opposite the female end, which is inserted in the opening provided by a socket of lead-pipe of the instrument or the main body of the instrument, in the case that the transducer apparatus 20 replaces the lead-pipe.

The player blows into the mouthpiece 16 and the vibrating lips create a buzzing sound that is detected by a microphone 25 located in the socket 50. The sound of this buzzing is muted using a series of baffles 17 provided in the cavity 32. If the primary frequency of the buzzing closely matches one of the harmonics of the fingered note, then the processor 41 determines that harmonic should be synthesized, as described later. A pressure sensor 24 is provided in the transducer apparatus 20 in the socket 50 to detect the force of the player's blowing and provided a pressure signal which is used by the processor 41 to determine the volume of the note.

Figure 3:
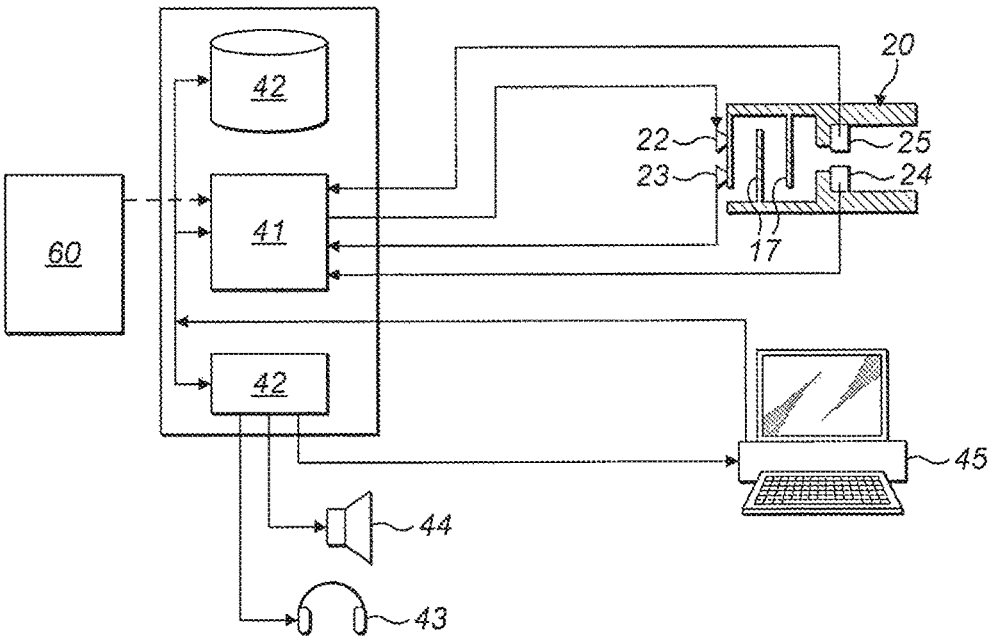
FIG. 3 is a circuit diagram illustrating the functioning of the electronics of the transducer apparatus.

Turning now to FIG. 3 the electronic processor 41 produces an excitation signal injected by the loudspeaker 22 in the resonant cavity 28 with the sound in the resonant chamber 28 measured by the co-located microphone 23. As described below, a logarithmic or exponential chirp can be used as an excitation signal.

In use the transducer apparatus 20 will be mounted on the trumpet 10 between the mouthpiece 16 and the resonant cavity 28. The player will then blow through the mouthpiece 16 while manually operating valves 11, 12, 13 of the trumpet 10 to thereby select a note to be played by the instrument. The blowing will be detected by the pressure sensor 24 which will send a pressure signal to the processor 41. The processor 41 in response to the pressure signal will output an excitation signal to the speaker 22, which will then output sound to the resonant chamber 28. The frequency and/or amplitude of the excitation signal is varied having regard to the pressure signal output by the sensor 24, so as to take account of how hard and when the player is blowing. The frequency and/or amplitude of the excitation signal can also be varied having regard to an ambient noise signal output by an ambient noise microphone (not shown in the figures) separate and independent of the microphone 23, which measures the ambient noise outside the resonant chamber 28, e.g. to make sure that the level of sound output by the speaker 22 is at least greater than preprogrammed minimum above the level of the ambient noise.

The microphone 23 will receive sound in the resonant chamber 28 and output a measurement signal to the processor 41. The processor 41 also receives a signal from the microphone 25 indicating the frequency of vibration of the player's lips. The processor will compare the signals (or spectra thereof) with each other and with pre-stored signals (or pre-stored spectra), stored in a memory device 42 to find a best match (this could be done after removing from the measurement signal the ambient noise indicated by the ambient noise signal provided by the ambient noise microphone). Each of the pre-stored signals or spectra will correspond with a musical note. By finding a best match between the measurement signals (or spectra thereof) and the pre-stored signals (or spectra thereof) the processing device thereby determines the musical note played. The processor 41 incorporates a synthesizer which synthesizes an output signal representing the detected musical note. This synthesized musical note is output by output device 42, e.g. a wireless transmitter, to wireless headphones 43, so that the player can hear the selected note output by the headphones, and/or to a speaker 44 and/or to a personal computer or laptop 45. A connection is provided by use of an frequency modulated infra-red LED signal output by the output device 42 to be received by commercially available infra-red signal receiving headphones; the use of such FM optical transmission advantageously reduces transmission delays.

The processor 41 will use signals from the microphone 23, the microphone 25 and the pressure sensor 24 in the process of detecting what musical note has been selected and/or what musical note signal is synthesized and output. The pressure sensor signal will indicate the strength of the breath of the player and hence the strength of the musical note desired. The apparatus needs both the tube length harmonics of the resonant chamber 28, determined from the output of the microphone 23, and the player's lips harmonic, determined from the output of the microphone 25, in order to determine whether there is a sufficiently close match in order for there to be an audible outcome output by the apparatus 20 (this will be described in more detail below with reference to FIG. 4)

The transducer apparatus 20 as described above has the following advantages:

i) It is a device easily capable of being fitted to and removed from a standard instrument.

ii) It has integral sensors which allow selection of the excitation signal output by the speaker and also allow control of when a synthesized musical note is output.

iii) It has integral embedded signal processing and wireless signal output.

iv) It allows communication of data to a laptop, tablet or personal computer/computer tablet/smart-phone application, with can run software providing a graphical user interface, including a visual display on a screen of live musical note spectra.

v) It can be provided optionally with a player operated integral excitation volume control.

vi) It can be provided with an ambient noise sensing microphone which allows integral ambient noise cancellation from the air chamber microphone measurement signal. It may be advantageous to have the ambient noise microphone as close to the instrument as possible to give an accurate ambient noise reading vii) Its processor 41 includes an integral synthesizer providing a synthesized musical note output for aural feedback to the player.

viii) It includes and is powered by an internal battery and so does not requires leads connected to the device which might inhibit the mobility of the player of the reed instrument.

ix) It advantageously processes the microphone signal in electronics mounted on the instrument and hence close to microphone to keep low any latency in the system and to minimize data transmission costs and losses.

The embodiment above introduces an electronic stimulus by a small speaker 22 of the transducer apparatus 20. The stimulus is chosen such that the resonance produced by depressing any combination of key(s) causes the acoustic waveform, as picked up by the small microphone 23, which may be placed close to the stimulus provided by the speaker 22, to change. Therefore analysis of the acoustic waveform, when converted into an electric measurement signal by microphone 23, and/or derivatives of the signal, allows the identification of the valve positions. The stimulus provided via the speaker 22 can be provided with very little energy and yet with appropriate processing of the measurement signal, the intended note can still be recognized. This can provide to the player of the instrument the effect of playing a near-silent instrument.

The identification of the intended notes gives rise to the synthesis of a musical note, typically, but not necessarily, chosen to mimic the type of instrument played. The synthesized sound will be relayed to headphones or other electronic interfaces such that a synthetic acoustic representation of the notes played by the instrument is heard by the player. Electronic processing can provide this feedback to the player in close to real-time, such that the instrument can be played in a natural way without undue latencies. Thus the player can practice the instrument very quietly without disturbing others within earshot.

The electronic processor 41 can use one or more of a variety of well-known techniques for analyzing the measurement signal in order to discover a transfer function of the resonant cavity 28 and thereby the intended note, working either in the time domain or the frequency domain.

These techniques include application of maximum length sequences either on an individual or repetitive basis, time-domain reflectometry, swept sine analysis, chirp analysis, and mixed sine analysis.

In one embodiment the stimulus signal sent to the speaker 22 will be a stimulus-frame including tone fragments chosen for each of the possible musical notes of the instrument. The tones can be applied discretely or contiguously following on from each other. Each of the tone fragments may include more than one frequency component. The tone fragments are arranged in a known order to generate the stimulus-frame. The stimulus-frame is applied as an excitation to the speaker, typically being initiated by the player blowing into the instrument. A signal comprising a version of the stimulus-frame as modified by the acoustic transfer function of the resonant chamber is picked up by the microphone 23. The time-domain measurement signal is processed, e.g. by a filter bank or fast Fourier transform (fft), to provide a set of measurements at known frequencies. The frequency measures allow recognition of the played note, either by comparison with pre-stored frequency measurements of played notes or by comparison with stored frequency measurements obtained via machine learning techniques. Knowledge of ordering and timing within the stimulus-frame may be used to assist in the recognition process.

The stimulus-frame typically is applied repetitively on a round-robin basis for the period that air-pressure is maintained by the player (as sensed by the sensor 24). The application of the stimulus frame will be stopped when the sensor 24 gives a signal indicating that the player has stopped blowing and the application of the stimulus frame will be re-started upon detection of a newly timed note as indicated by the sensor 24. The timing of a played note output signal, output by the processor 41, on identification of a played note, is determined by a combination of the recognition of the played note and the pressure signal from the sensor 24. The played note output signal is then input to synthesis software run on the processor 41 such that a mimic of the played note is output, the synthesized musical note signal and the timing thereof are offered back to the player typically for instance via wireless headphones 43.

It is desirable to provide the player with low-latency feedback of the played note, especially for low frequency notes where a single cycle of the fundamental frequency may take tens of milliseconds. A combination of electronic processing techniques may be applied to detect such notes with low latency by applying a tone or tones at different frequencies to the fundamental such that the played note may still be detected from the response.

In one embodiment the excitation signal sent to the speaker 22 is an exponential chirp. This signal excites the resonant chamber of the reed instrument via the loudspeaker on a repetitive basis, thus forming a stimulus-frame. The starting frequency of the scan is chosen to be below the lowest fundamental (first harmonic) of the instrument. The sound present in the resonant chamber 28 is sensed by the microphone 23 and assembled into a frame of data lasting exactly the same length as the exponential chirp excitation signal (which provides the stimulus-frame). Thus the frames of microphone data and the chirp are synchronized. An FFT is performed upon the frame of data in the measurement signal provided by the microphone 23 and a magnitude spectrum is thereby generated in a standard way.

The transducer apparatus can have a training mode in which the player successively plays all the notes of the instrument and the resultant magnitude spectra of the measurement signals provided by the microphone are stored correlated to the notes being played. The transducer apparatus 20 is provided with a signal receiver as well as its signal transmitter and communicates with a laptop, tablet or personal computer 45, or a smartphone, running application software that allows player control of the transducer apparatus 20. The application software can allow the player to select the training mode of the transducer apparatus 20. Typically the memory device 42 of the apparatus will allow three different sets of musical note data to be stored. In the training mode, the player will select a set and then will select a musical note for storing in the set. The player will play the relevant musical note (e.g. operating the relevant valves of a trumpet) and will then use the application software to initiate recording of the measurement signal from the microphones 23 and 25. The transducer apparatus 20 will then cycle through a plurality of cycles of generation of an excitation signal and will average the measurement signals obtained over these cycles to obtain a good reference response for the relevant musical note. The process is then repeated for each musical note played by the instrument. When all musical notes have been played and reference spectra stored, then the processor 41 has a set of stored spectra in memory 42 which include a training set. Several (e.g. three) training sets may be generated (e.g. for different instruments), for later selection by the player. The laptop, tablet or personal computer or smartphone 45 will have a screen and will display a graphical representation of each played musical note as indicated by the measurement signal. This will allow a review of the stored spectra and a repeat of the learning process of the training mode if any defective musical note data is seen by the player.

Rather than use application software on a separate laptop, tablet or personal computer or smartphone 45, the software could be run by the electronic processor 41 of the transducer apparatus 20 itself and manually operable controls, e.g. buttons, provided on the transducer apparatus 20, along with a small visual display, e.g. LEDs, that provides an indication of the selected operating mode of the apparatus 20, musical note selected and data set selected.

An accelerometer (not shown) could be provided in the transducer apparatus 20 to sense motion of the transducer apparatus 20 and then the player could move the instrument to select the input of the next musical note in the training mode, thus removing any need for the player to remove his/her from the instrument between playing of musical notes. Alternatively, the electronic processor 41 or a laptop, tablet or personal computer 45 or smartphone in communication therewith could be arranged to recognize a voice command such as 'NEXT' received e.g. through an ambient noise microphone (not shown) or a microphone of the laptop, tablet or personal computer or smartphone. As a further alternative, the pressure signals provided by the sensor 24 could be used in the process, recognizing an event of a player stopping blowing and next starting blowing (after a suitable time interval) as a cue to move from learning one musical note to the moving to learning the next musical note.

When the transducer apparatus 20 is then operated in play mode a pre-stored training set is pre-selected. The selection can be made using application software running on a laptop, tablet or personal computer 45 or on a smartphone in communication with the transducer apparatus 20. Alternatively the transducer apparatus 20 could be provided with manually operable controls to allow the selection. The magnitude spectrum is generated from the measurement signal as above, but instead of being stored as a training set it is compared with each of the spectra in the training set (each stored spectrum in a training set representing a single played note). A variety of techniques may be used for the comparison, e.g. at least squares difference technique or a maximized Pearson second moment of correlation technique. Additionally machine learning techniques may applied to the comparison such that the comparison and or training sets adjusted over time to improve the discrimination between notes.

It is convenient to use only the magnitude spectrum of the measurement signal from a simple understanding and visualization perspective, but the full complex spectrum of both phase and amplitude information (with twice as much data) could also be used, in order to improve the reliability of musical note recognition. However, the use of just the magnitude spectrum has the advantage of speed of processing and transmission, since the magnitude spectrum is about 50% of the data of the full complex spectrum. References to 'spectra' in the specification and claims should be considered as references to: magnitude spectra only; phase spectra only; a combination of phase and amplitude spectra; and/or complex spectra from which magnitude and phase are derivable.

In an alternative embodiment a filter bank, ideally with center frequencies logarithmically spaced, could be used to generate a magnitude spectrum, instead of using a Fast Fourier Transform technique. The center frequencies of the filters in the bank can be selected in order to give improved results, by selecting them to correspond with the frequencies of the musical notes played by the reed instrument.

Thus the outcome of the signal processing is a recognized note, per frame (or chirp) of excitation. The minimum latency is thus the length of the chirp plus the time to generate the spectra and carry out the recognition process against the training set. The processor 41 typically runs at 93 ms for the excitation signal and −30 ms for the signal processing of the measurement signal. It is desirable to reduce the latency even further; an FFT approach this will typically reduce the spectral resolution since fewer points will be considered, assuming a constant sample rate. With a filter bank approach there will be less processing time available and the filters will have less time to respond, but the spectral resolution need not necessarily be reduced.

The synthesized musical note may be transmitted to be used by application software running on a laptop, tablet or personal computer 25 or smartphone or other connected processor. The connection may be wired or wireless using a variety of configurations, e.g. Bluetooth®. A connection may be provided by use of an frequency modulated infra-red LED signal output by the output device 42 to be received by commercially available infra-red signal receiving headphones; the use of such FM optical transmission advantageously reduces transmission delays. Parameters which are not critical to operation but which are useful, e.g. the magnitude spectrum, may also be passed to the application software for every frame. Thus the application software can generate an output on a display screen which allows the player to see a visual effect in the frequency spectrum of playing deficiencies of the player. This allows a player to adjust his/her playing and thereby improve his/her skill.

In a further embodiment, an alternate method of excitation signal generation and processing the measurement signal is implemented in which an excitation signal is produced comprising of a rich mixture of frequencies, typically harmonically linked.

The measurement signal is analyzed by a filter-bank or fft to provide a complex frequency spectrum. Then the complex frequency spectrum is run through a recognition algorithm in order to provide a first early indication of the played note. This could be via a variety of recognition techniques including those described above. The first early indication of the played note is then used to dynamically modify the mixture of frequencies of the excitation signal in order to better discriminate the played note. Thus the recognition process is aided by feeding back spectral stimuli which are suited to emphasizing the played note. The stages are repeated on a continuous basis, perhaps even on a sample by sample basis. A recognition algorithm provides the played note as an additional output signal.

In the further embodiment the content of the excitation signal is modified to aid the recognition process. This has parallels with what happens in the conventional playing of a reed instrument in that the reed provides a harmonic rich stimulus which will be modified by the acoustic feedback of the reed instrument, thus reinforcing the production of the played note. However, there are downsides in that a mixture of frequencies as an excitation signal will fundamentally produce a system with a lower signal to noise ratio (SNR) than that using a chirp covering the same frequencies, as described above. This is because the amplitude at any one frequency is necessarily compromised by the other frequencies present if the summed waveform has to occupy the same maximum amplitude. For instance if the excitation signal includes a mixture of 32 equally weighted frequencies, then the overall amplitude of the sum of the frequencies will be 1/32 of that achievable with a scanned chirp over the same frequency range and this will reflect in the SNR of the system. This is why use of a scanned chirp as an excitation signal, as described above, has an inherent superior SNR; but the use of a mixture of frequencies in the excitation signal which is then enhanced might allow the apparatus to have an acceptably low latency between the note being played and the note being recognized by the apparatus.

With suitable communications, application software running on a device external to the instrument and/or the transducer apparatus may also be used to provide a backup/restore facility for the complete set of instrument data, and especially the training sets. The application software may also be used to demonstrate to the user the correct spectrum by displaying the spectrum for the respective note from the training set. The displayed correct spectrum can be displayed alongside the spectrum of the musical note currently played, to allow a comparison.

Since the musical note and its volume are available to the application software per frame, a variety of methods may be used to present the played note to the player, These include a simple textual description of the note, e.g. G #3, or a (typically a more sophisticated) synthesis of the note providing aural feedback, or a moving music score showing or highlighting the note played, or a MIDI connection to standard music production software e.g. Sibelius, for display of the live note or generation of the score.

The application software running on a laptop, tablet or personal computer 45 or smartphone in communication with the transducer apparatus and/or as part of the overall system of the disclosure will allow: display on a visual display device of a graphical representation of a frequency of a played note; the selection of a set of data stored in memory for use in the detection of a played note by the apparatus; player control of volume of sound output by the speaker; adjustment of gain of the pressure sensor; adjustment of volume of playback of the synthesized musical note; selection of a training mode and of a playing mode operation of the apparatus; selection of a musical note to be learned by the apparatus during the training mode; a visual indication of progress or completion of the learning of a set of musical notes during the training mode; storage in the memory of the laptop, tablet or personal computer or smartphone (or in cloud memory accessed by any of them) of the set of data stored in the on-board memory of the transducer apparatus, which in turn can export (e.g. for restoration purposes) a set of data to the on-board memory 42 of the transducer apparatus 20; a graphical representation, e.g. in alphanumeric characters, of the played note; a musical note by musical note graphical display of the spectra of the played notes, allowing continuous review by the player; generation of e.g. pdf files of spectra. The application software could additionally be provided with a feature enabling download and display of musical scores and exercises to help those players learning to play an instrument. The application software can also allow downloading a new firmware (program) file for the instrument processor 41 either from the local computer or from a website. A user can select 'Update instrument firmware' using the application software and the instrument is then updated with the latest firmware automatically from a website.

Whilst above the identification of a played note and the synthesis of a musical note is carried out by electronics on-board to the transducer apparatus, these processes could be carried out by separate electronics physically distant from but in communication with the apparatus mounted on the instrument or indeed by the application software running on the laptop, tablet or personal computer or smartphone. The generation of the excitation signal could also occur in the separate electronics physically distant from but in communication with the apparatus mounted on the instrument or by the application software running on the laptop, tablet or personal computer or smartphone.

The transducer apparatus 200 will retain in memory 42 the master state of the processing and all parameters, e.g. a chosen training set. Thus the transducer apparatus 200 is programmed to update the process implemented thereby for all parameter changes. In many cases the changes will have been initiated by application software on the laptop, tablet or personal computer or smartphone, e.g. choice of training note. However, the transducer apparatus 200 will also generate changes to state sensed locally, e.g. by the pressure sensor 24 and/or in response to the note currently most recently recognized.

Whilst above an electronic processor 41 is included in the device coupled to the instrument which provides both an excitation signal and outputs a synthesized musical note, a fast communication link between the instrument mounted device and a laptop, tablet or personal computer or smartphone would permit application software on the laptop, tablet or personal computer or smartphone to both generate the excitation signal (which is then relayed to the speaker mounted on the instrument) and also to receive the measurement signal (from the microphone) and then detect therefrom the musical note played and to synthesize the musical note played e.g. by a speaker of the laptop, tablet or personal computer or smartphone or relayed to headphones worn by the player. A microphone built into the laptop, tablet or personal computer or smartphone could be used as the ambient noise microphone. The laptop, tablet or personal computer or smartphone would also receive signals from a pressure sensor and/or an accelerometer when they are used.

The synthesized musical notes sent e.g. to headphones 43 worn by a player of the reed instrument could mimic the instrument played or could be musical notes arranged to mimic sounds of a completely different instrument. In this way an experienced player could by way of the disclosure play his/her brass instrument and thereby generate the sound of a e.g. a played guitar. This sound could be heard by the player only by way of headphones or broadcast to an audience via loudspeakers.

It could be useful to have a mode in which the breath control was switched off and the player could hold the instrument away from the mouth and practice fingerings. In this situation there is no way for the player to select the relevant harmonic with the lips. This could be overcome by introducing a strap-on array of buttons 60 towards the direction of the trumpet bell—see FIGS. 1 and 2. For trombones and trumpets the left hand is used to support the instrument but the fingers would be free to operate the buttons. For trombones the button array would be close to the mouthpiece because this is where trombonists support the instrument. The optional button assembly would be linked the rest of the device by an umbilical or wirelessly. The optional nature of the use of button array 60 is indicated by the use of dotted lines in FIG. 3.

Figure 2:
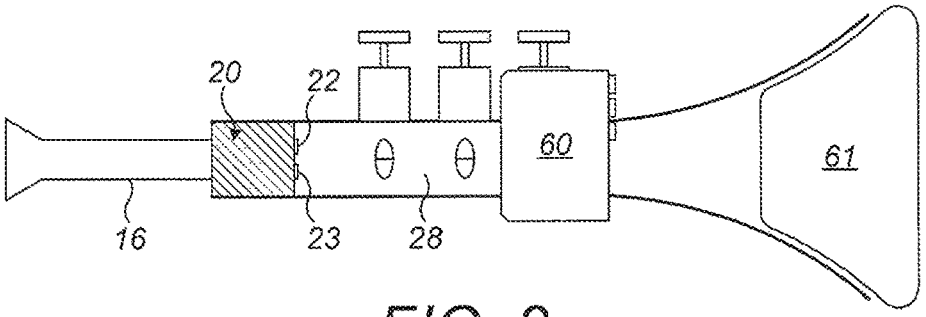
FIG. 2 is a schematic view in part cross-section of the FIG. 1 trumpet with a transducer apparatus.

Since there are no finger holes in a brass instrument the tube is completely sealed except at the bell and hence the sound can be reduced by putting a mute 61 in that opening (see FIGS. 1 and 2). This does change the playing characteristics, but the instrument still resonates at, or close to, the unmuted frequencies. Mutes are used to confer a different quality of sound but also to reduce the volume, as is the case with practice mutes. Putting a mute in the end of the instrument will help in keeping extraneous noise out of the resonant chamber 28 and will reduce the volume of the chirp that escapes from the instrument.

Figure 4:
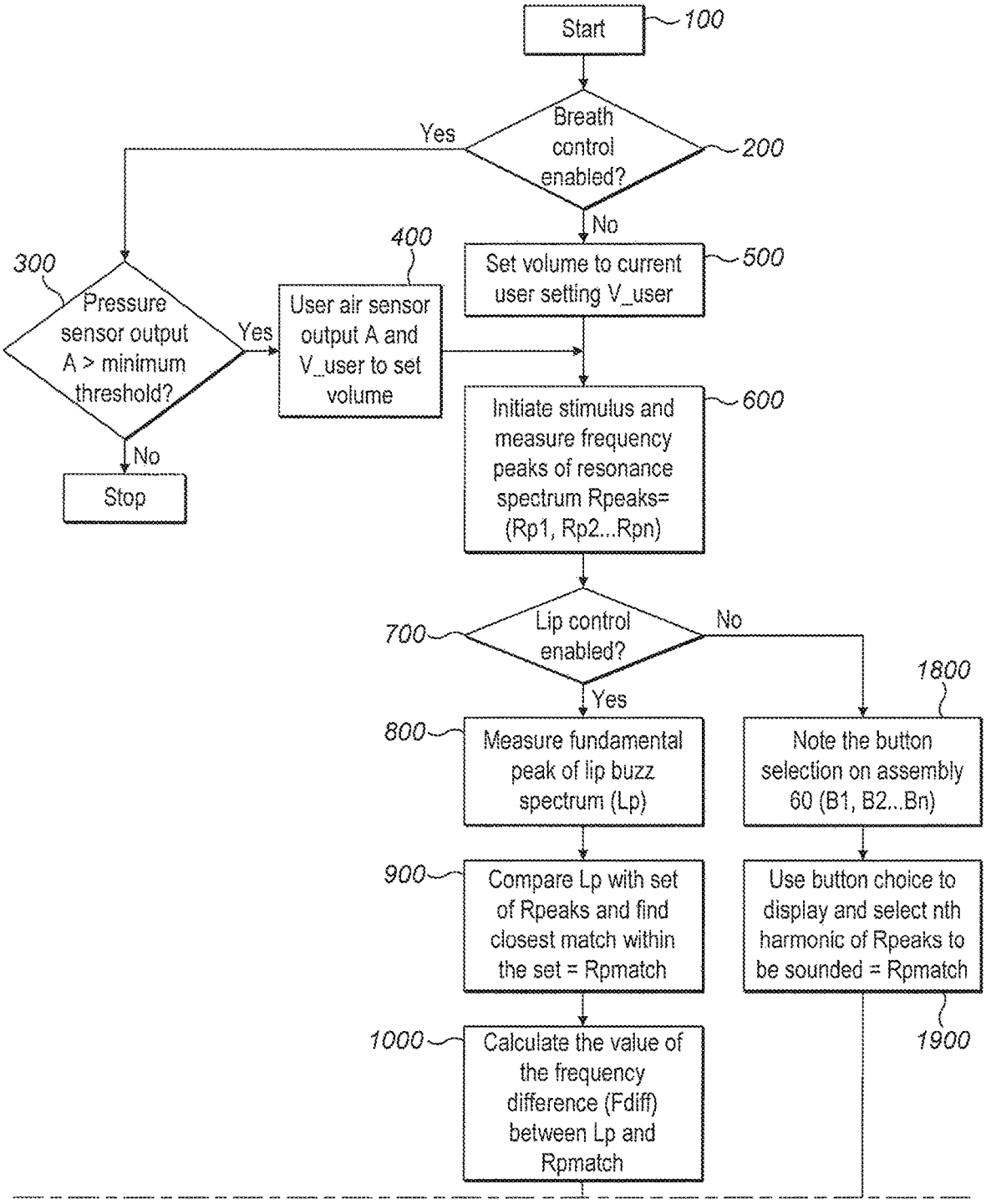
FIG. 4 is a flow chart illustrating the method of operation of the transducer apparatus of the disclosure.
Figure 4:
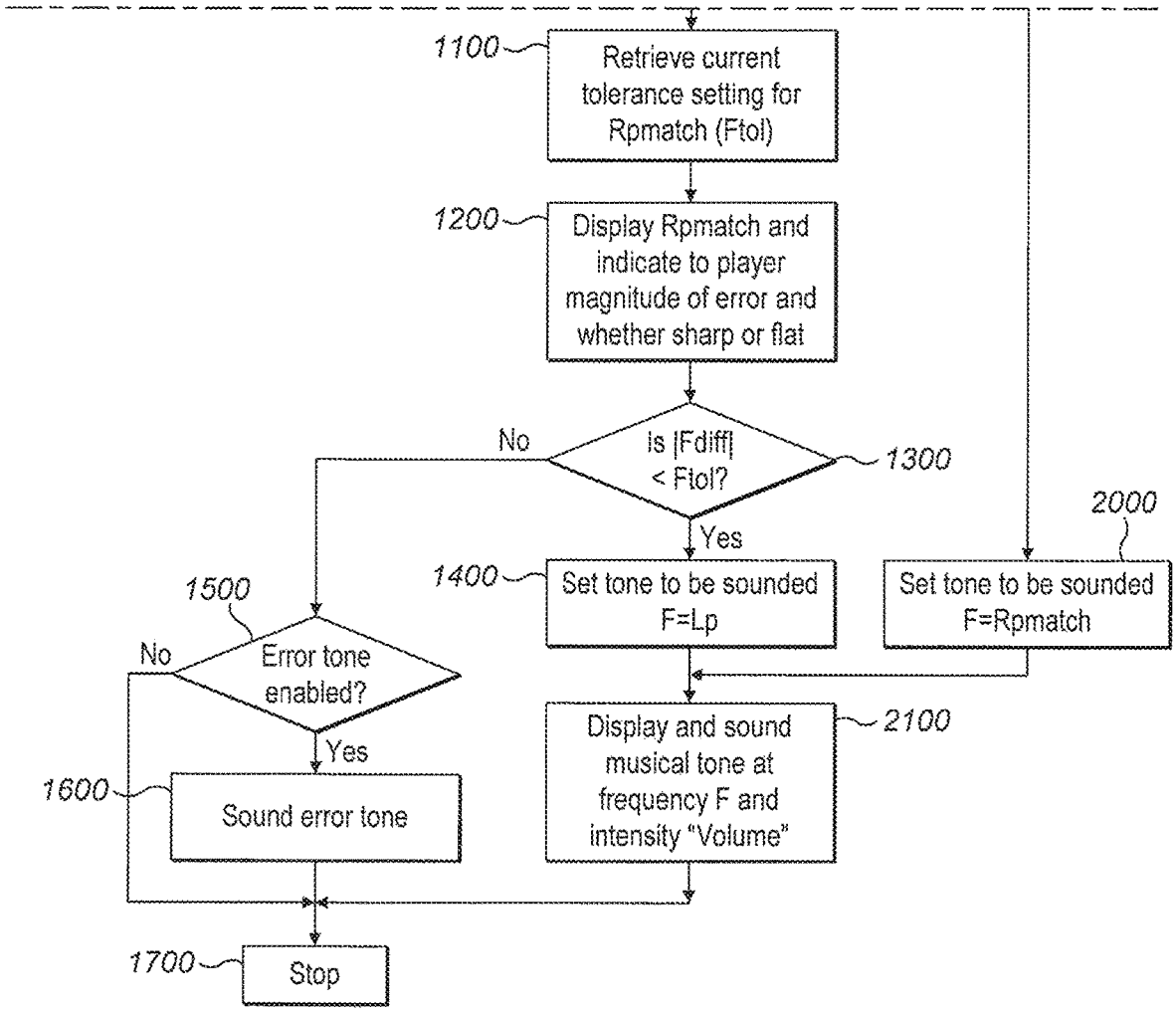

FIG. 4 attached is a flow diagram illustrating the method of operation of the transducer apparatus 20 described above. The flow diagram shows a single cycle of operation, which will be repeated continuously while the transducer apparatus remains in operation.

The cycle starts at stage 100, initially when the transducer apparatus is activated using an on/off button provided on its housing.

If the transducer apparatus is provided with the ability to function with or without breath control, as described above, then at stage 200 the user selects whether or not to practice with breath control. This can be done by use of a selector button provided on the transducer housing or separately on the instrument (e.g. the array of buttons 60) or by a use of control software provided on a computer (e.g. a laptop) or a smartphone in communication with the transducer 200. The apparatus could be set to default to breath control unless any of the buttons of the array 60 provided for selection of a harmonic are depressed by the user.

If breath control is selected, then at 300 the processor 41 reads the pressure signal from the pressure sensor 24 and determines if the sensed pressure is above a minimum threshold. If the pressure sensed is above the minimum threshold then at stage 400 a volume for the stimulus signal and/or the musical note output by the apparatus is determined from the magnitude of the sensed pressure and a volume control input from the user (input using a manually operable control provided on the transducer itself or by use of control software running on a computer (e.g. a laptop) or a smartphone in communication with the transducer 200). Additionally or alternatively a signal from an ambient noise sensor (e.g. a microphone on the laptop or the smartphone) can be used to set the volume of the stimulus signal and/or the musical note output by the apparatus.

If at stage 300 the pressure signal is below the minimum threshold then the system realizes that the user has not started to use the instrument and no further action is taken until the signal from the pressure sensor 24 indicates that the user is blowing into the mouthpiece. The cycle is restarted at 100.

If at stage 200 use of the transducer apparatus 20 without breath control is selected, then at stage 500 the volume of the stimulus signal and/or the musical note output by the apparatus is set by a volume control input from the user (input using a manually operable control provided on the transducer itself or by use of control software running on a computer (e.g. a laptop) or a smartphone in communication with the transducer 200). Additionally or alternatively a signal from an ambient noise sensor (e.g. a microphone on the laptop or the smartphone) can be used to set the volume of the stimulus signal and/or the musical note output by the apparatus.

At stage 600 the generation of stimulus signal via the speaker 22 is initiated by the processor 41 and then the microphone 23 is used to measure the frequency peaks of resonance spectrum Rpeaks, comprising a set of: Rp1, Rp2 to Rpn.

At stage 700 the transducer 20 determines whether the user has elected to blow into the mouthpiece to generate harmonics to be played by the instrument or to use the strapped on array of buttons 60 to select the harmonics to be played. The transducer could be set up to default to assume generation of harmonics by blowing by the user unless a button of the array 60 is activated.

If the user selects to generate harmonics by blowing then at stage 800 the signal from the microphone 25 is used by the processor 41 to measure the fundamental peak (Lp) of a lip buzz spectrum.

At stage 900 the processor 41 compares the Lp signal to with the set of peaks of the resonance spectrum Rpeaks to find the closest match Rpmatch At stage 1000 the processor 41 calculates a frequency difference Fdiff between the Lp signal and the closest matching peak Rpmatch of the peaks of the resonance spectrum.

At stage 1100 the processor 41 retrieves from the memory 42 a tolerance Ftol which is a user-defined or pre-programmed tolerance value which sets how close the buzz frequency Lp needs to be to the closest match resonance frequency Rpmatch for the two frequencies to be considered a match.

At stage 1200 the processor 41 outputs a signal to e.g. a computer or a smartphone to allow a visual indication of the matched signal Rmatch, the difference between Rmatch and Lp and whether the played note is sharp or flat.

At stage 1300 the processor 41 determines whether the calculated frequency difference Fdiff is less than the tolerance Ftol retrieved from memory.

If Fdiff is less than Ftol then at stage 1400 the tone F to be output by the processor 41 and heard via the headphones 43 and/or speaker 44 is set as either as Lp or as Rpmatch. The apparatus will either be set up to output as F either Lp or Rpmatch or the apparatus will allow the user to select whether Lp or Rpmatch is output as F, for instance through use or manually operable control provided on the transducer apparatus or by use of control software on a computer or smartphone connected to the transducer apparatus. The use of Rpmatch as the output F will allow the user (or his/her audience) to hear a 'correct' note played at a resonant frequency, regardless of whether the Lp frequency is not a close match (provided that it is within the set tolerance). The use of Lp as the output F will allow the user to hear the actual frequency of the buzzing of the lips and give 'real' feedback to allow the user to improve his/her playing by changing the lip buzz. The system could be set up to use F=Lp for the visual display of e.g. the computer 45 and F=Rpmatch for the audio signal played via the headphones 43 and/or speaker 44; or vice versa, If Fdiff is more that Ftol then at stage 1500 the transducer 20 determines whether the user as chosen that an error tone is signaled. If so, then an error tone is output at stage 1600 by the processor 41 and heard via the headphones 43 and/or speaker 44 and then the cycle stops at stage 1700, to be re-started at stage 100 while the transducer 20 remains active. If not, then the cycle stops at stage 1700 (without the sounding of an error signal and without the output of any sound at all), to be re-started at stage 100 while the transducer 20 remains active. The method acts to prevent the output of a tone at a frequency Rpmatch or Ftol when the difference between them is beyond an acceptable tolerance. This corresponds to a 'real life' labrosone, which when played will emit a muted sound unless the frequency of the lip buzz matches one of the harmonics of the instrument.

If the user has decided to play the instrument without blowing into the mouthpiece and instead uses the buttons of the array 60, then this is noted at stage 700 and then at stage 1800 the processor determines which button(s) of the array 60 have been selected and at stage 1900 uses the selection to determine which of peak harmonic of the set of Rpeaks is to be the chosen harmonic Rpmatch. Then at 2000 the tone F to be sounded is set as Rpmatch.

At stage 2100 of the method the tone F is output by the processor 41 to be represented visually on the screen of a computer or smartphone and to be output as sound via the headphones 43 and/or speaker 44. The volume of the output sound can be controlled by a user volume input (using a manually operable control of the transducer 20 or software on the computer or smartphone) and/or having regard to the pressure sensed by the sensor 24 (see stages 400 and 500).

From stage 2100 the method moves to a stop at stage 1700, for the cycle to then be re-started at stage 100 while the transducer 20 remains active.

Whilst above the transducer apparatus is provided with both an array of buttons 60 and also a lip buzz microphone 25 and pressure sensor 24, which allows the apparatus to function with different modes of operation, involving breath and/or lip control and button control, in simplified versions of the apparatus the apparatus could: dispense with the button array 60; dispense with the microphone 25; or dispense with both the microphone 25 and the pressure sensor 24; as will now be described.

In a simplified version of the apparatus without the button array, then the stages 200, 500, 700, 1800, 1900 and 2000 with be omitted from the method described above and illustrated in FIG. 4. The apparatus will operate always with breath control and lip control and always with the stages 300, 4000, 800, 900, 1000, 1100, 1200, 1300, 1400, 1500, 1600, 1700 and 2100. The apparatus will always use the output from the pressure sensor 24 in setting the volume and will always compare the lip buzz spectrum with the frequency peaks Rpeaks to find a best match Rpmatch. The frequency peaks will, of course, change as the transfer function of the resonant cavity is changed e.g. using valves in a trumpet or the slide of a trombone.

In another simplified version of the apparatus a button array is provided, but the microphone 25 is dispensed with and the user always uses the button array to select a harmonic from the set of harmonics Rpeaks determined from the output of microphone 23 at stage 600. In this version it is possible to retain or dispense with pressure sensor 24. If the pressure sensor 24 is retained, then the method described above and illustrated in FIG. 4 will be simplified by dispensing with stages 700, 800, 900, 1000, 1200, 1300, 1400, 1500 and 1600 and the method will always operate with the stages 1800, 1900 and 2000 in which the button choice is used to select a harmonic from the set Rpeaks as the harmonic Rpmatch and then F is set as Rpmatch and sounded as a musical tone. If the pressure sensor 24 is dispensed with then the method described above and illustrated in FIG. 4 will be additionally simplified by dispensing with stages 200, 300 and 400 and the volume of the stimulus signal and/or the output volume is always set by the user in the method stage 500.

Above there has been mentioned the use of an ambient microphone placed outside but close to the instrument. An alternative way of sensing ambient noise would be to use the instrument microphone 23, by controlling operation of the speaker 22 to have a period of silence e.g. along with the chirp. During the silence the output of the microphone 23 would be used by the processor to analyses ambient noise. The processor 41 would then modify the chirp response received from the microphone 23 in the light of the ambient noise.

The invention claimed is:

1. A transducer apparatus for a labrosone, the labrosone having a labrosone resonant chamber, the transducer apparatus comprising:

a labrosone speaker configured to deliver a sound signal to the labrosone resonant chamber;

a labrosone microphone configured to receive sound in the labrosone resonant chamber;

a mouthpiece microphone configured to receive sound from a labrosone mouthpiece; and an electronic processor configured to receive signals from the labrosone microphone and the mouthpiece microphone, the electronic processor connected to the labrosone speaker, wherein during use of the apparatus:

the mouthpiece microphone receives sound from the labrosone mouthpiece;

the electronic processor generates an excitation signal which is delivered as an acoustic excitation signal to the labrosone resonant chamber by the labrosone speaker;

the labrosone microphone receives a resulting sound from the labrosone resonant chamber;

the electronic processor uses the signals from the labrosone microphone and the mouthpiece microphone to determine a desired musical note which a player of the labrosone wishes to play; and the electronic processor synthesizes the desired musical note and outputs the synthesized note to one or more of: headphones, a speaker external to the transducer apparatus, a computer apparatus, and/or a smartphone, whereby the synthesized note is played audibly and/or displayed visually to the player.

2. The transducer apparatus of claim 1, further comprising;

a housing including a transducer chamber which is independent and separate from the labrosone resonant chamber, the housing configured to be connected to the labrosone mouthpiece, wherein the transducer chamber is configured to receive vibrating air from the labrosone mouthpiece when the housing is connected to the labrosone mouthpiece.

3. The transducer apparatus of claim 2, further comprising baffles in the transducer chamber.

4. The transducer apparatus of claim 2, wherein the labrosone speaker and the labrosone microphone are mounted on the housing.

5. The transducer apparatus of claim 2, wherein the housing has a male end that is configured to be insertable into a socket of the labrosone which usually receives the labrosone mouthpiece or a lead-pipe of the labrosone, and wherein the housing has a female socket end having a socket into which the labrosone mouthpiece is configured to be insertable.

6. The transducer apparatus of claim 5, wherein the mouthpiece microphone is located in the socket of the female socket end.

7. The transducer apparatus of claim 1, further comprising a pressure sensor which is configured to measure air pressure in the labrosone mouthpiece and/or in the transducer chamber and to thereby provide a pressure signal to the electronic processor, which uses the pressure signal to determine a timing and/or a volume of the synthesized musical note.

8. The transducer apparatus of claim 2, further comprising a pressure sensor which is configured to measure air pressure in the mouthpiece and/or in the transducer chamber and to provide a pressure signal to the electronic processor, which uses the pressure signal to determine a timing and/or a volume of the synthesized musical note, and wherein:

the housing has a male end that is configured to be insertable in a socket of the labrosone which usually receives the labrosone mouthpiece or a lead-pipe of the labrosone, the housing has a female socket end having a socket into which the labrosone mouthpiece is configured to be insertable, and the pressure sensor is located in the socket of the female socket end.

9. The transducer apparatus of claim 1, further comprising one or more electric or electronic buttons configured to be mounted on the labrosone which are in connection with the electronic processor and allow a player to select a harmonic to be generated by the transducer apparatus.

10. A transducer apparatus for a labrosone, the labrosone having a labrosone resonant chamber, the transducer apparatus comprising:

a labrosone speaker configured to deliver a sound signal to the labrosone resonant chamber;

a labrosone microphone configured to receive sound in the labrosone resonant chamber;

one or more electric or electronic buttons configured to be mounted on the labrosone which allow a player to select a harmonic to be generated by the transducer apparatus; and an electronic processor configured to receive signals from the labrosone microphone and the one or more electric or electronic buttons, the electronic processor connected to the labrosone speaker, wherein during use of the apparatus:

the electronic processor generates an excitation signal which is delivered as an acoustic excitation signal to the labrosone resonant chamber by the labrosone speaker;

the labrosone microphone receives a resulting sound from the labrosone resonant chamber;

the electronic processor uses the signals from the labrosone microphone and the one or more electric or electronic buttons to determine a desired musical note which a player of the labrosone wishes to play; and the electronic processor synthesizes the desired musical note and outputs the synthesized note to one or more of: headphones, a speaker external to the transducer apparatus, a computer apparatus, and/or a smartphone, whereby the musical note is played audibly and/or displayed visually to the player.

11. The transducer apparatus of claim 10, further comprising:

a housing including a transducer chamber which is independent and separate from the labrosone resonant chamber and which is configured to be connected to a mouthpiece of the labrosone, wherein the transducer chamber is configured to receive vibrating air from the labrosone mouthpiece when the housing is connected to the labrosone mouthpiece.

12. The transducer apparatus of claim 11, further comprising baffles in the transducer chamber.

13. The transducer apparatus of claim 11, wherein the labrosone speaker and the labrosone microphone are mounted on the housing.

14. The transducer apparatus of claim 11, wherein the housing has a male end that is configured to be insertable into a socket of the labrosone which usually receives the mouthpiece or a lead-pipe of the labrosone, and wherein the housing has a female socket end having a socket into which the mouthpiece of the labrosone is configured to be insertable.

15. The transducer apparatus of claim 11, further comprising a pressure sensor which is configured to measure air pressure in the labrosone mouthpiece and/or in the transducer chamber and to thereby provide a pressure signal to the electronic processor, which uses the pressure signal to determine a timing and/or a volume of the synthesized musical note.

16. The transducer apparatus of claim 15, further comprising a memory device, wherein the electronic processor uses the received signals to determine a desired musical note which the player of the labrosone wishes to play, the determination including comparing the labrosone microphone signal or a spectrum thereof with pre-stored signals or spectra held in the memory device of the transducer apparatus to determine a match.

17. The transducer apparatus of claim 16, wherein:

the excitation signal includes a plurality of tone fragments corresponding to musical notes that can be played by the labrosone, the tone fragments being arranged in an ordered set by the electronic processor to form a stimulus-frame, and the electronic processor is configured to process the labrosone microphone signal to generate a set of measurements at known frequencies which are then compared, by the electronic processor, to sets of values held in the memory device to determine the match.

18. The transducer apparatus of claim 16, wherein the excitation signal is an exponential chirp, and wherein the electronic processor is configured to process the labrosone microphone signal to generate the frequency spectrum thereof, and to compare the frequency spectrum to sets of frequency spectra held in the memory device to determine the match.

19. The transducer apparatus of claim 16, further comprising a filter bank that is configured to generate a magnitude spectrum from the labrosone microphone signal.

20. The transducer apparatus of claim 16, wherein the electronic processor is configured to implement a cycle in which a first excitation signal is produced that includes a first mixture of frequencies, then a frequency spectrum of the resulting labrosone microphone signal is analyzed by the electronic processor to give a first indication of the desired musical note, next the electronic processor adapts the first mixture of frequencies of the excitation signal based on the first indication of the desired musical note to thereby produce a second adapted excitation signal for a second mixture of frequencies, then the electronic processor outputs the second adapted excitation signal and the resulting labrosone microphone signal is analyzed by the electronic processor to give a second indication of the desired musical note which is used by the electronic processor to determine the musical note to be synthesized.

21. The transducer of claim 16, further comprising:

a computer apparatus and/or a smartphone which is configured to receive the output synthesized note, wherein the computer apparatus and/or the smartphone is configured to control one or more of:

a display of a graphical representation of a frequency of the synthesized note;

a visual indication of progress or completion of learning of a set of musical notes during a training mode in which signals or spectra are held in the memory device;

storage in a memory device of the computer apparatus or smartphone, of the set(s) of data stored in the memory device of the transducer apparatus;

a graphical representation in alphanumeric characters of the synthesized note;

a visual display of the synthesized note by of the spectrum of the synthesized note; and a download and display of musical scores.

22. The transducer of claim 16, further comprising a computer apparatus and/or a smartphone which is configured to receive the output synthesized note, wherein the computer apparatus and/or the smartphone is configured to send control signals to the transducer apparatus to thereby allow a user to control one or more of:

a selection of a set of data stored in the memory device for use in the detection of a played note by the transducer apparatus;

control of a volume of sound output by the speaker;

adjustment of a gain of the pressure sensor;

adjustment of a volume of playback of the synthesized musical note;

selection of a training mode or a playing mode operation of the transducer apparatus; and selection of a musical note whose spectrum is to be stored in the memory device during a training mode of the transducer apparatus.

23. A labrosone comprising a transducer apparatus, the labrosone having a labrosone resonant chamber and a labrosone mouthpiece, the transducer apparatus comprising:

a labrosone speaker configured to deliver a sound signal to the labrosone resonant chamber;

a labrosone microphone configured to receive sound in the labrosone resonant chamber;

a mouthpiece microphone configured to receive sound from the labrosone mouthpiece; and an electronic processor configured to receive signals from the labrosone microphone and the mouthpiece microphone, the electronic processor connected to the labrosone speaker, wherein during use of the apparatus:

the mouthpiece microphone receives sound from the labrosone mouthpiece;

the electronic processor generates an excitation signal which is delivered as an acoustic excitation signal to the labrosone resonant chamber by the labrosone speaker;

the labrosone microphone receives a resulting sound from the labrosone resonant chamber;

the electronic processor uses the signals from the labrosone microphone and the mouthpiece microphone to determine a desired musical note which a player of the labrosone wishes to play; and the electronic processor synthesizes the desired musical note and outputs the synthesized note to one or more of: headphones, a speaker external to the transducer apparatus, a computer apparatus, and/or a smartphone, whereby the synthesized note is played audibly and/or displayed visually to the player.

* * * * *